350-3.6 SR
XR 4,023,969 R
TX 3021Y

United States

Sheridon

4,023,969

May 17, 1977

[54] DEFORMABLE ELASTOMER IMAGING MEMBER EMPLOYING AN INTERNAL OPAQUE DEFORMABLE METALLIC LAYER

[75] Inventor: Nicholas K. Sheridon, Saratoga, Calif.

[73] Assignee: Xerox Corporation, Stamford, Conn.

[22] Filed: Jan. 3, 1975

[21] Appl. No.: 538,281

[52] U.S. Cl. ..... 96/1.5; 96/1.1; 96/27 H; 358/6.6 TP; 358/129; 340/173 TP; 346/151; 346/77 R; 346/77 E; 350/3.5

[51] Int. Cl.[2] ..... G03G 5/00; G03G 17/00

[58] Field of Search ..... 96/1.1, 1.5; 346/74 TP, 346/77 R, 77 E; 340/173 TP

[56] References Cited

UNITED STATES PATENTS

| | | | |
|---|---|---|---|
| 2,896,507 | 7/1959 | Mast et al. | 96/1.1 X |
| 3,137,762 | 6/1964 | Baumgartner et al. | 96/1.1 X |
| 3,716,359 | 2/1973 | Sheridon | 96/1.1 |
| 3,877,791 | 4/1975 | Roach | 96/1.1 X |

OTHER PUBLICATIONS

Sheridon, "The Ruticon Family of Erasable Image Recording Devices," *IEEE Transactions On Electron Devices*, vol. ed.-19, No. 9, Sept. 1972, pp. 1003-1010.

*Primary Examiner*—Edward C. Kimlin
*Assistant Examiner*—John R. Miller
*Attorney, Agent, or Firm*—James J. Ralabate; Richard A. Tomlin; Gaetano D. Maccarone

[57] ABSTRACT

An imaging system comprising an imaging member including a deformable metallic layer arranged between a pair of deformable layers, at least one of which comprises an elastomer material. In operation an electrical field is established across the deformable layers to cause deformation thereof in imagewise configuration. The imaging member may include photoconductive material and may include a pair of electrodes for establishing an electrical field across the deformable layers. In one embodiment the electrodes may comprise an electrical X-Y matrix address system.

11 Claims, 2 Drawing Figures

DEFORMABLE ELASTOMER IMAGING MEMBER EMPLOYING AN INTERNAL OPAQUE DEFORMABLE METALLIC LAYER

BACKGROUND OF THE INVENTION

This invention relates to an imaging system and more particularly to an imaging system comprising a multilayered deformation imaging member.

There is known in the imaging art a broad class of imaging members which record optical images by an imagewise distribution of photogenerated voltages or currents acting upon a voltage or current-alterable recording medium. Typically, in these members, imagewise activating radiation incident on a photoconductor allows charge carriers to move in an external electric field. These charge carriers interact with a voltage or current sensitive member which, in turn, modulates light. Many of these members are deformation imaging members.

U.S. Pat. No. 2,896,507 describes an imaging member which includes a photoconductive layer and an elastically deformable layer sandwiched between a pair of electrodes, one of which is a thin metallic layer overlying the deformable layer. In operation, imagewise activating radiation is directed upon the member and an electrical field is established across the photoconductive and deformable layers thus causing these layers to deform in imagewise configuration. The member is described as being capable of functioning as an image intensifier since the deformation image may then be read out with a high intensity light source and a Schlieren optical system.

U.S. Pat. No. 3,716,359 discloses a family of imaging members called Ruticons (derived from the Greek words "rutis" for wrinkle and "icon" for image) wherein the voltage sensitive, light modulating recording medium comprises a deformable elastomer layer and the photoconductive material may be provided as a separate layer or incorporated in the elastomer layer. Various different embodiments for establishing an electrical field across the elastomer layer are disclosed.

U.S. Pat. No. 3,485,550 discloses apparatus capable of increasing the intensity of an optically produced image. In one embodiment the apparatus includes a pair of elastically deformable layers sandwiched around a liquid reflecting layer. Another image display device is described in "Zeitschrift fur Angewandte Mathematik and Physik" 18, 1967, pages 31 to 57. A photoconductive layer is separated from an elastomer layer by a thin air space. An imagewise voltage distribution in the photoconductor layer causes a corresponding deformation of the elastomer air interface. Still another type of surface deformation imaging device, described in "Photographic Science and Engineering," 15, No. 6, November-December 1971, includes a thermoplastic layer overcoated on a photoconductive layer. The former layer deforms upon heating to reproduce a surface deformation pattern corresponding to a voltage distribution in the photoconductor layer. A nonconductive metal layer is vacuum deposited onto the thermoplastic layer to enhance the optical reflectivity of the latter. The present invention relates to an imaging system which includes a deformable imaging member.

SUMMARY OF THE INVENTION

It is an object of this invention to provide a novel imaging system.

It is another object to provide novel deformation imaging members.

It is a further object to provide imaging members including a deformable metallic layer arranged between a pair of deformable layers, at least one of which comprises an elastomer material.

It is still another object to provide such imaging members which further include a pair of electrodes for establishing an electrical field across the member.

It is yet another object to provide imaging members wherein a pair of electrodes comprise an electrical X-Y matrix address system.

Another object is to provide imaging members which include photoconductive insulating material.

Still another object is to provide methods for using the imaging members of the invention.

BRIEF SUMMARY OF THE INVENTION

These and other objects and advantages are accomplished in accordance with the present invention by providing an imaging system comprising an imaging member including a deformable metallic layer arranged between a pair of deformable layers, at least one of which comprises an elastomer material. In operation an electrical field is established across the deformable layers to cause deformation thereof in imagewise configuration. The imaging member may include photoconductive material and may include a pair of electrodes for establishing an electrical field across the deformable layers. In one embodiment the electrodes may comprise an electrical X–Y matrix address system.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
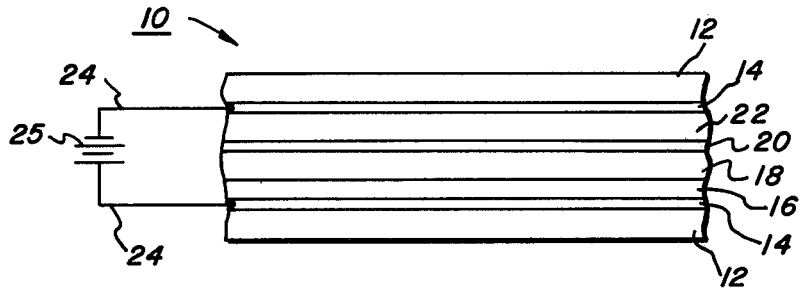
FIG. 1 is a partially schematic cross-sectional view of an embodiment of an imaging member according to the invention.

In FIG. 1 there is shown in partially schematic cross-sectional view an imaging member, generally designated 10, wherein substantially transparent substrates 12 and substantially transparent conductive layers 14 comprise a parallel pair of substantially transparent electrodes. Overlying the bottom electrode is a layer of photoconductive insulating material 16 which in turn carries deformable layer 18. In another embodiment the photoconductive insulating material may be incorporated in deformable layer 18 such as where layer 18 comprises an elastomer material, thus obviating the necessity for layer 16. Overlying deformable layer 18 is deformable metallic layer 20 which in turn carries another deformable layer 22. At least one of deformable layers 18 and 22 comprises an elastomer material. The electrodes are connected to potential source 25 through leads 24. Potential source 25 may be A.C., D.C., or a combination thereof. The external electrical circuit may also include suitable switching means (not shown).

It should be noted that one or both of the electrodes are not required when the electrical field is established by means of corona charging. For example, the field may be established by the double sided corona charging technique wherein one corona charging device is arranged on each side of the imaging member or alternatively one side of the imaging member may be corona charged while the other side is grounded. Of course, it is possible to have a substrate in the imaging member when the field is established in this manner, however, in this case it need not be laterally conductive.

In operation of the imaging member an electrical field is established between the electrodes and with the field on an imagewise pattern of activating electromagnetic radiation is directed upon the imaging member. The electrical field induces a flow of charge in the regions of the photoconductive layer 16 which are exposed to the radiation thus varying the field across layers 18, 20, and 22. The mechanical force of the electrical field causes deformable layers 18 and 22 to deform at their interfaces with layer 20 in a pattern corresponding to the imagewise activating radiation. The metallic layer 20 is sufficiently flexible to follow the deformations of layers 18 and 22. Metallic layer 20 is preferably not highly electrically conductive; however, it may be electrically conductive to some extent providing the mechanical stiffness typically associated with conductive metal layers is not of sufficient magnitude to interfere with the requisite flexibility of the layer as will be explained in detail below herein.

It will be recognized that the activating electromagnetic radiation must reach photoconductive layer 16 in order for imaging to occur. Moreover, metallic layer 20 is typically optically opaque and highly reflective. Accordingly, in the embodiment illustrated in FIG. 1 the bottom electrode should be transparent to allow the image information to reach photoconductive layer 16 and the upper electrode should also be transparent to allow readout illumination to be reflected from the surface of deformable metallic layer 20. Thus, the imaging member may be imaged continuously with image information impinging from below the member and the recorded image information may be read out continuously with readout illumination incident from above the imaging member. Metallic layer 20 serves, inter alia, to enhance the reflectivity of the imagewise deformed surfaces of deformable layers 18 and 22 and to shield the photoconductive layer (when present) from readout illumination. Accordingly, the imaging members of the invention are particularly adapted to be read out in reflection.

As aforesaid, the bottom electrode of the imaging member 10 may comprise any suitable transparent conductive material. The electrode may be a single layer of conductive material or it may comprise, as illustrated in FIG. 1, a transparent conductive layer arranged on a suitable transparent support substrate such as, for example, glass or plastic materials. Typical suitable transparent conductive layers include continuously conductive coatings of conductors such as tin, indium oxide, aluminum, chromium, tin oxide or any other suitable conductors. These substantially transparent conductive coatings are typically evaporated onto the more insulating transparent substrate. NESA glass, a tin oxide coated glass manufactured by the Pittsburgh Plate Glass Company, is a commercially available example of a typical transparent conductive layer coated over a transparent substrate. In the embodiment shown in FIG. 1 the top electrode may comprise any of the materials described immediately above.

Any typical suitable photoconductive insulating material may be used for layer 16. Typical suitable photoconductive insulating materials include, for example, selenium, poly-n-vinylcarbazole (PVK), poly-n-vinylcarbazole doped with sensitizers such as Brilliant Green Dye, phthalocyanine, and 2,4,7-trinitro-9-fluorenone (TNF); cadmium sulfide, cadmium selenide; zinc oxide, sulfur, anthracene, and tellurium. Additionally, photoconductive layer 16 may comprise a finely ground photoconductive insulating material dispersed in a high resistance electrical binder such as is disclosed in U.S. Pat. No. 3,121,006 to Middleton et al, or an inorganic photoconductive insulating material such as is disclosed in U.S. Pat. No. 3,121,007 to Middleton et al, or an organic photoconductor such as phthalocyanine in a binder. Generally, any photoconductive insulating material or composition may be used for layer 16.

The thickness of the photoconductive layer 16 is typically in the range from about 0.1 micron to about 200 microns or more; the thickness of the layer in any particular instance depends, inter alia, largely upon the spatial frequency of the information to be recorded. Photoconductive layer 16 may be formed on substrate 14 by any of the many methods which are well-known to those skilled in the art including, for example, vacuum evaporation, dip coating from a solution, etc. It is again noted that the photoconductive material may be included in deformable elastomer layer 18 thus obviating the need for layer 16.

Deformable layer 18 may comprise any suitable elastomer material, dielectric liquid or dielectric gas. The term "elastomer" in the various forms used herein is defined as a usually amorphous material which exhibits a restoring force in response to a deformation; that is, an amorphous material which deforms under a force, and, because of volume and surface forces, tends to return to the form it had before the force was applied. Typical suitable elastomeric soft solid materials for use in the imaging devices of the invention include both natural (such as natural rubber) and synthetic polymers which have rubber-like characteristics, i.e., are elastic, and include materials such as styrene-butadiene, polybutadiene, neoprene, butyl, polyisopropene, nitrile, urethane and ethylene rubbers. A preferred class of elastomer materials includes water-based gelatin gels and dimethylpolysiloxane gels. Where layer 18 comprises an elastomer it generally should be a reasonably good insulator and typically have a volume resistivity above about $10^4$ ohm-cm and shear modulus of from about 10 to about $10^8$ dynes/cm$^2$ and a dielectric strength above about 10 volts/mil. Preferably such elastomers will have volume resistivities above about $10^{13}$ ohm-cm, shear moduli of from about $10^2$ to about $10^5$ dynes/cm$^2$ and dielectric strengths greater than about 500 volts/mil. Commercially available elastomers which have been found suitable for use include: Sylgard 182, Sylgard 184, Sylgard 188 (available from Dow Corning Co.), RTV 602 and RTV 615 (available from General Electric Co.). The higher volume resistivity elastomers are preferred since they typically provide extended image storage capability. Elastomers having relatively high dielectric strength are preferred because they typically allow the devices to be operated at relatively high voltage levels which is desirable.

A particularly preferred elastomer is a transparent, very compliant composition which comprises an elastomeric dimethylpolysiloxane gel made by steps including combining about one part by weight of Dow Corning No. 182 silicone resin potting compound, about 0.1 part by weight of curing agent and anywhere from about zero to about thirty parts by weight of Dow Corning No. 200 dimethylpolysiloxane silicone oil. Other suitable resins include transparent flexible organosiloxane resins of the type described in U.S. Pat. No. 3,284,406 in which a major portion of the organic groups attached to silicon are methyl radicals.

The thickness of elastomer layer 18 is typically in the range of from about 0.1 microns to about 200 microns depending, inter alia, upon the spatial frequency of the information to be recorded. Various optical properties of the imaging member may be enhanced by a suitable selection of the elastic modulus of the particular elastomer material used. For example, a relatively more stiff elastomer will typically recover more rapidly from an image when the electric field is removed and thus may be erased more quickly. On the other hand, an elastomer material having a relatively low elastic modulus is typically capable of greater deformations and hence greater optical modulation for a given value of electric field. The elastomer material may be coated on the photoconductor layer 16 as a monomer and polymerized in situ or it may be coated on the photoconductor surface from solutions in volatile solvents which will evaporate and leave a thin uniform layer. The elastomer layer may also be formed by spin coating, roller coating and other techniques.

Where deformable layer 18 comprises a dielectric liquid or a dielectric gas the liquids and gases suitable for use typically have good electrically insulating properties, preferably having volume resistivities above about $10^{13}$ ohm-cm, and may have any dielectric constant or optical properties. In general, it is preferred that the materials have relatively high dielectric strengths in order to allow high voltage use of the member where it is desired. Particularly preferred gases for use in layer 18 are the noble gases, argon, neon and helium because of their relatively high electrical breakdown strengths. Typical suitable dielectric liquids include silicon and fluorosilicon oils such as, for example, Dow Corning FS-1265 oil (a fluorosilicon oil of high purity) and these are preferred because of their high chemical stabilities and low viscosities. It should be noted that more reactive oils may tend to change the electrical properties of adjacent elastomer layers.

Deformable layer 22 may comprise any suitable relatively conductive elastomer, liquid or gas. It is again noted that at least one of deformable layers 18 and 22 comprises an elastomer material; of course, both of these layers may comprise appropriate elastomer materials. Layer 22 typically should be substantially more conductive than deformable layer 18 so that most of the electrical field, and hence most of the associated mechanical force, will fall across deformable layer 18 for formation of the surface deformation image. Typically, deformable layer 18 should be at least about two orders of magnitude less conductive than deformable layer 22. Generally, whereas the thickness of deformable layer 18 will be governed by the desired spatial frequency response behavior of the imaging member, the thickness of deformable layer 22 does not have any similar restrictions imposed on it provided the electrical conductivity of the material comprising layer 22 is sufficiently high.

Typical suitable conductive gases for use in deformable layer 22 may be provided by the use of glow discharge, for example, in a noble gas at a moderate vacuum pressure or by means of a corona discharge in a gas typically held at atmospheric pressure. Typical suitable electrically conductive liquids and elastomers may be provided from electrically insulating liquids or elastomers to which there has been added suitable agents to produce the requisite conductivity characteristics. For example, the insulating silicone based liquids and elastomers described previously may be made suitably conductive for use in deformable layer 22 by the addition thereto of such agents as oleic acid, bis-tri-n-butyltinmaleate or finely divided particles of metals. It is preferred to employ chemical additives for this purpose since the metallic particles may tend to compromise the optical quality of the liquids and elastomers. The requisite conductivity for deformable layer 22 in any particular instance is dependent typically upon the thickness of the layer and the conductivity of the material which comprises deformable layer 18. Preferably the material comprising deformable layer 22 will have a volume resistivity of less than about $10^8$ ohm-cm and the layer thickness is less than about 1 mm. It is again noted that layer 22 generally may be of any thickness.

Deformable metallic layer 20 serves, inter alia, to increase the reflectivity of the imagewise deformed surfaces of the adjacent deformable layers 18 and 22 to shield the photoconductive layer 16 from readout illumination which impinges from above the imaging member in the reflective readout mode. Layer 22 is preferably non-conductive because whereas the above-described functions may be provided by conductive metallic layers, the latter typically are stiff by virtue of their microstructure and consequently limit deformation. It is possible to produce non-conductive metallic layers having very low levels of mechanical stiffness in addition to being highly reflective and opaque and thereby allow large imagewise surface deformations at moderate voltages. The later conductivity characteristics of the meterial comprising deformable metallic layer 20 typically do not play any electrical part in the operation of imaging member 10 and it is therefore preferred to form non-conductive layers to minimize the mechanical stiffness. Generally, conductivities over distances short compared to the periodicity of the means typically used to spatially modulate the image information (as will be described in detail hereinafter) or comparable to the period of the highest image spatial frequency of interest arepreferred inasmuch as the associated mechanical stiffness willnot be significantly adverse to the deformation of the metal layer at these spatial frequencies.

It has been noted that with many metals the fact of lateral conductivity in layers thereof brings with it a resistance to bending or deformation at higher spatial frequencies whereas it is also possible to deposit metallic layers that do not possess any significant resistance to deformation and which also are typically found to possess little or no substantial lateral conductivity. It is possible to obtain good optical opacity and reflectivity with such non-conductive metallic layers. Examination of the microstructure of such metallic films usually reveals an unlinked island structure for thin layers and a highly porous structure for thicker layers. Such structures are not likely to undergo fatigue from repeated deformations as are solid metal layers and thus they typically may have even longer useful imaging cycle lifetimes. It is also possible that the smaller island structures may coalesce into larger islands thereby giving rise to the short distance conductivity described above.

Nonconductive metallic layers may be formed by vacuum deposition, by sputtering, and by similar methods directly onto the surface of the deformable layer 18. One such preferred technique involves the vacuum deposition of a multiplicity of pairs of chromium and indium layers. This procedure begins with the deposition of about 200 Angstroms of chromium, followed by the deposition of about 600 Angstroms of indium. A multiplicity of such layers is built up. In each case the indium deposition is terminated when a decrease in optical reflectivity indicates the growth of undesireably large indium crystals on the surface. Application of the chromium appears to terminate such crystal growth. In this manner good quality reflective optical films having optical densities in excess of 4 and having lateral resistivities in excess of $10^4$ ohms/square can be formed. Metallic layer 20 may have an optical density of about 0.1 or greater.

In general, only the low melting point metals have the property of forming the unlinked island structures characteristic of many nonconductive metal films. The production of such films is generally enhanced by their deposition onto low surface energy substrates like the silicone elastomers. Other methods of producing such nonconductive films include the vacuum deposition of indium alone and the vacuum deposition of tin. The above preferred technique is suited to the production of higher optical density nonconductive films than can be conveniently done with the single metal systems. It should be noted that where deformable layer 18 comprises a gas, the deformable metallic layer would be formed by depositing the same on deformable layer 22 which in that instance would comprise an elastomer material.

Potential source 25 provides D.C. voltage of one polarity to form a deformation image at the interface between deformable layers 18 and 22. The polarity required depends upon the nature of the photoconductor. The voltage drop across layers 16, 18, 20 and 22 will be in the range of from about 1 to about 25,000 volts depending upon the modulus of elasticity of the material comprising layer 18 and its thickness, the modulus of elasticity of the material comprising layer 22 and its thickness as well as certain properties of the photoconductor. Potential source 25 must be capable of being turned off to erase the image and, in some cases, to undergo a shift in polarity to erase the image more rapidly. For a television type of picture wherein approximately 30 complete images per second are formed, stored and erased, the power supply must be capable of undergoing such cycles with appropriate speed. The extent of the deformation and the rapidity with which information may be erased is dependent upon the voltages supplied by the power source. The stability of the voltage output of the power source must be great enough to prevent unwanted erasure of the image. An alternate scheme for erasing the surface deformation image is to position a strobe light below imaging member 10 to flood the photoconductive layer 16 with light thereby erasing the modulated field pattern across the structure set up by the imagewise light. This operation is appropriate as long as the fields across the deformable layers 18, 20 and 22 are below a level causing the surface deformations to be locked. To form and lock the deformation image, the values of voltage between the electrodes would be approximately between 1 and 25,000 volts depending upon the thickness, the elastic modulus and other characteristics of the deformable layers. The phenomenon of image locking has been described in U.S. Pat. No. 3,716,359. Briefly, it occurs when the voltage distribution across the elastomer due to its imagewise surface deformation is sufficient to maintain the deformation despite removal of the imagewise voltage distribution across the photoconductor.

The images formed in the imaging member will typically erase because of any of a number of reasons. For example, charge carriers may be injected into the deformable layer from the upper electrode and pass through the deformable layer to reach the photoconductor-deformable layer 18 interface; or image generated charge carriers present at the photoconductor-deformable layer 18 interface may flow laterally; or charge carriers may be injected into the deformable layer 18 from the photoconductor—deformable layer interface and reach the upper electrode. All of these effects cause the contrast potential across the deformable layer to diminish or disappear. The images may be erased more quickly by removing the field from across the deformable layers or by reversing the polarity of the field. For even more rapid erasure, the photoconductor may be flooded with activating electromagnetic radiation at the same time that the field is removed or the polarity thereof reversed.

It should be noted that other elements besides those described herein and illustrated in FIG. 1 may be incorporated in the advantageous imaging members of the invention. According to a preferred embodiment of the invention, images having spatial frequencies substantially lower than the resonant deformation frequency of the material comprising layer 18 can be recorded by placing an absorption type line grating between the projected light image and the photoconductor upon which it is imaged. The deformable layer 18 will deform along the pattern of the high spatial frequency screen in those areas where it is illuminated. The screened deformation image will then be made up of segments of the shadow of the screen. The image obtained by illuminating the deformed layers will thus have a fine structure of lines superimposed upon the original image that was recorded. If this line structure is objectionable, it may be removed by suitable optical filtering techniques well-known in the art. For the imaging members of the invention, the preferred location of the screen, e.g., a line grating, is immediately adjacent to the photoconductive layer in the member. Other types of screens that may be similarly located are described in U.S. Pat. Nos. 3,698,893 and 3,719,483.

A number of variations of the various elements may be substituted for those used in the imaging members set forth above and illustrated in FIG. 1. As stated previously, adjacent photoconductive and elastomer layers may be replaced by a single layer of a photoconductive elastomer. Also, a plurality of elastomer layers having different thicknesses and/or elastic moduli could be used instead of single elastomer layer to provide a broad or multiply peaked spatial frequency response.

In another embodiment of an imaging member according to the invention, which has a configuration identical to that illustrated in FIG. 1, both of the deformable layers 18 and 22 are electrically insulating, for example, having volume resistivities above about $10^8$ ohm-cm. In this embodiment deformable layer 22 comprises an electrically insulating material which allows deformation of the deformable layer 22 — metallic layer 20 interface to occur when the member is used in the imaging mode described above. Generally, in this embodiment, the fields across the deformable layers typically should divide capacitively thus effecting deformation of their common surface. Also, the upper deformable layer should have a dielectric constant which is different than that of the lower deformable layer, for example, at least about 1% different and preferably substantially different. The deformable metallic layer in this embodiment should be substantially electrically insulating over distances small compared with the spatial frequency of the information desired to be recorded. Only limited lateral conductivity in the deformable metallic layer can be tolerated in this embodiment, particularly where other than very short term storage is desired for the deformation image. The deformable layers may comprise appropriate elastomer materials, liquids or gases. Again it is noted that at least one of the deformable layers should comprise an elastomer. Conductivities over distances comparable to or large compared with the periods of these spatial frequencies should be limited in magnitude by the desired duration of storage of the recorded image. Generally, lateral resistivities of $10^4$ ohms/square or greater for metallic layer 20 are typically required for imaging members operating at spatial frequencies of 10 *l*p/mm and above for image storage times of 1/10 second or greater.

Figure 2:
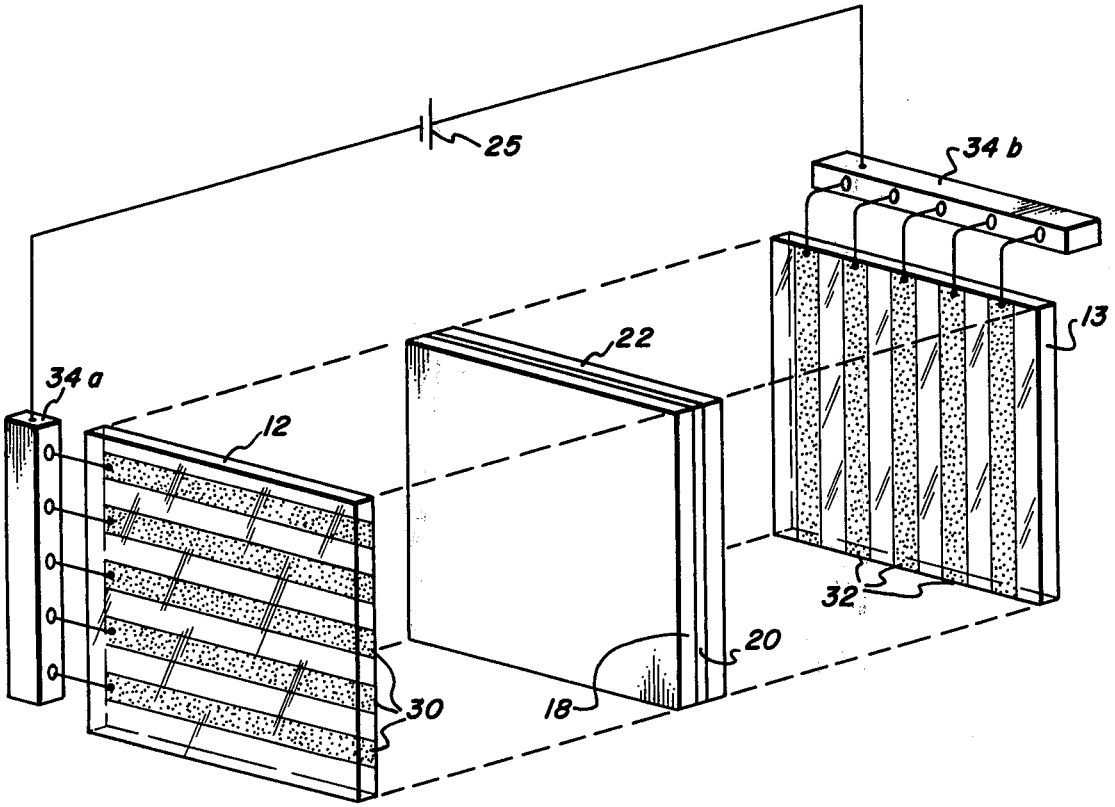
FIG. 2 is an exploded isometric view of an imaging system wherein an imaging member according to the invention is imaged by an electrical X–Y matrix address system.

In FIG. 2 an electrical X-Y matrix address system suitable for imaging an imaging member according to the invention is illustrated. The deformable layers 18 and 22 and the deformable metallic layer 20 are sandwiched between a pair of transparent electrodes. The front transparent electrode comprises transparent support substrate 12 upon which strips of substantially transparent conductive material 30 are coated. The rear electrode comprises substrate 13 which may be transparent or opaque upon which are coated strips of conductive material 32 which may be transparent or opaque. The electrodes are arranged so that conductive strips 30 and 32 on the respective electrodes cross each other in an X–Y matrix grid. Each conductive strip in each set of parallel strips 30 and 32 is electrically connected to a circuit system 34 which is suitable for selective or sequential operation. Through selection systems 34*a* and 34*b* and an external circuit including potential source 25 an electrical field for creating a deformation image in the imaging member according to the present imaging system can be established across selected points or a selected sequence of points. It will be understood that conductive strips 30 and 32 may vary in width from a very fine wire-like configuration to any desired width.

Although the above-described embodiments for establishing an imagewise electrical field across the deformable layers to cause deformation thereof have been described in detail it should be noted that the invention is not limited thereto. Generally, any technique for establishing an imagewise electrical field across the deformable layers of the member may be utilized.

The imaging members of the invention may be used in numerous application such as, for example, for image storage, as optical buffers, for image intensification, etc. For a detailed description of some specific applications for these imaging members see U.S. Pat. No. 3,716,359.

Although the invention has been described with respect to various preferred embodiments thereof, it should be recognized that it is not limited thereto but rather various modifications will occur to and be made by those skilled in the art upon a reading of the present disclosure and such changes are within the spirit of the invention and the scope of the claims.

1. A deformation imaging member comprising a series of contiguous layers including an opaque deformable metallic layer arranged between a first and second deformable layer, wherein said first and second deformable material layers each comprise an elastomer having a volume resistivity above about $10^8$ ohm-cm and said first deformable elastomer containing layer having a dielectric constant which differs from that of said second deformable elastomer containing layer by at least about 1% and contiguous with the surface of the first deformable layer, opposite to the surface in contact with the deformable metallic layer, a layer of photoconductive insulating material.

2. The imaging member as defined in claim 1 wherein said deformable metallic layer has a lateral resistivity of about $10^3$ ohms/square or greater and said first deformable material layer has a thickness of from about 0.1 micron to about 200 microns.

3. The imaging member as defined in claim 1 and further including a pair of transparent electrodes arranged to establish an electrical field across said deformable layers.

4. The imaging member as defined in claim 3 and further including spatial light modulation means disposed between one of said electrodes and said photoconductive insulating layer.

5. The impinging member as defined in claim 4 wherein said first deformable material layer comprises an elastomer material having a volume resistivity of about $10^{13}$ ohm-cm or greater.

6. The imaging member as defined in claim 5 wherein said deformable metallic layer has an optical density of about 4 or more.

7. A deformable imaging member comprising a series of contiguous layers including a pair of transparent electrodes, one of said electrodes being coated with a layer of photoconductive insulating material, and an opaque deformable metallic layer arranged between a first and second layer of deformable elastomer material, said first layer of deformable elastomer material being contiguous with the layer of photoconductive insulating material, said deformable metallic layer having a lateral resistivity of about $10^4$ ohms/square or greater, said first deformable elastomer layer having a volume resistivity above about $10^8$ ohm-cm and a thickness in the range of from about 0.1 to about 200 microns, and said second deformable elastomer layer having a volume resistivity less than about $10^8$ ohm-cm.

8. The imaging member as defined in claim 7 and further including spatial light modulation means disposed between one of said electrodes and said photoconductive insulating layer.

9. The imaging member as defined in claim 8 wherein said first deformable material layer comprises an elastomer material having a volume resistivity of about $10^{13}$ ohm-cm or greater.

10. The imaging member as defined in claim 9 wherein said deformable metallic layer has an optical density of about 4 or greater.

11. The imaging member as defined in claim 7 wherein said second deformable material layer comprises a conductive elastomer.

* * * * *